US005461977A

United States Patent [19]

Germann

[11] Patent Number: 5,461,977

[45] Date of Patent: Oct. 31, 1995

[54] DEVICE FOR TRANSFERRING SINGLE SHEETS TO THE IMPRESSION CYLINDER OF A SHEET FED ROTARY PRINTING MACHINE

[75] Inventor: Albrecht J. Germann, Würzburg, Germany

[73] Assignee: De La Rue Giori S.A., Lausanne, Switzerland

[21] Appl. No.: 384,857

[22] Filed: Feb. 7, 1995

[30] Foreign Application Priority Data

Feb. 17, 1994 [CH] Switzerland ..... 00476/94

[51] Int. Cl.[6] ..... B41F 11/00

[52] U.S. Cl. ..... 101/137; 101/217; 101/410; 101/232; 271/234; 271/245; 271/253; 271/226

[58] Field of Search ..... 101/232, 233, 101/234, 235, 236, 237, 238, 239, 240, 217, 137; 271/226, 233, 234, 236, 243, 244, 245, 246, 247, 248, 249, 253, 254, 206, 227

[56] References Cited

U.S. PATENT DOCUMENTS

| | | | |
|---|---|---|---|
| 2,395,445 | 2/1946 | Belluche | 101/410 |
| 3,993,302 | 11/1976 | Weisgerber | 271/245 |
| 4,311,093 | 1/1982 | Abendroth et al. | 101/232 |
| 4,402,266 | 9/1983 | Sugiyama | 101/409 |
| 4,588,184 | 5/1986 | Jeschke | 271/237 |
| 4,892,307 | 1/1990 | Barrois et al. | 271/227 |
| 5,103,733 | 4/1992 | Drapatsky et al. | 101/232 |
| 5,125,336 | 6/1992 | Germann | 101/137 |
| 5,390,908 | 2/1995 | Luxem | 271/247 |

FOREIGN PATENT DOCUMENTS

| | | |
|---|---|---|
| 2325945 | 12/1973 | Germany . |
| 339275 | 7/1929 | United Kingdom . |

*Primary Examiner*—Eugene H. Eickholt
*Attorney, Agent, or Firm*—Kane, Dalsimer, Sullivan, Kurucz, Levy, Eisele and Richard

[57] ABSTRACT

The device has a sheet-transfer cylinder (2) with a movable setting plate (3) which bears the sheet grippers (4) and whose lateral ends are individually adjustable during each revolution of the transfer cylinder (2) with the aid in each case of a roller lever (9) in the circumferential direction in such a way that the sheet transferred to the impression cylinder is in a position which corresponds to the precise printing register. For this purpose, each roller lever (9) mounted movably on the transfer cylinder (2) is guided in a guide path (15*c*), surrounding the cylinder axis (1) in an annular manner, of an actuator (15, 16) which is suspended pivotably above the cylinder axis (1). Said actuator is provided with individually adjustable stops (19*a*, 19*b*) which, by interaction with peripheral cams (24*a* to 24*d*) pivot the relevant actuator (15, 16) by a predeterminable amount during each revolution of the transfer cylinder (2) and thus displace the relevant end of the setting plate (3).

6 Claims, 5 Drawing Sheets

DEVICE FOR TRANSFERRING SINGLE SHEETS TO THE IMPRESSION CYLINDER OF A SHEET FED ROTARY PRINTING MACHINE

FIELD OF THE INVENTION

The invention relates to a device for transferring single sheets to the impression cylinder of a sheet fed rotary printing machine according to the preamble of patent claim 1.

PRIOR ART

A device of this type has been disclosed by EP-A-0,467,832 of the same applicant. This device allows the position of a sheet to be constantly automatically adapted, remaining in register, to the position of the printing plate, which is printing it and is attached to the plate cylinder, during transfer to the impression cylinder. This obviates the necessity to adjust the printing plates themselves, when they are being attached to the plate cylinder, at precisely equal angular intervals, which is cumbersome and time-consuming. Deviations from the actual precise attachment position of the printing plates are corrected in the device mentioned by the automatic adjustment of the sheets on the transfer cylinder.

A common factor in the conventional sheet-transfer devices was that the arriving sheets are transferred to the impression cylinder precisely in the same rhythm, the transfer point of the transfer cylinder, at which the leading edge of the sheet is taken over by the grippers of the impression cylinder, always being the same. In order to achieve the fact that, when the sheets are printed, the spacing between the leading edge of the sheet and the beginning of print, that is to say the free top margin of the sheet, is constantly of equal width, due care had to be taken during the attachment of the printing plates on the plate cylinder that all the printing plates were mounted with precisely equal spacing, that is to say, in the case of a plate cylinder having two, three or four printing plates, had to have a precise angular interval of 180°, of 120° or of 90° respectively. The condition that all the printed sheets must have a top margin of equal size is extremely important, above all when printing security documents, in particular when printing bank notes, in which the sheets have a number of security-document prints arranged in rows and columns and are subsequently cut up into individual security documents. Different widths of the top margins of the sheets, whose leading edge serves as a reference edge for cutting, therefore lead to incorrect centering of the security documents and thus to rejection.

By means of the known device according to EP-A-0,467,832 described at the beginning, however, a correction of the sheet position can only be carried out in the one or the other circumferential direction, but the sheet cannot be adjusted slightly obliquely relative to the circumferential direction, if appropriate, if this were to be required by a correspondingly oblique attachment position of the printing plate on the plate cylinder. This means that, when the printing plates are being attached to the plate cylinder, although precisely equal angular intervals are not essential, a precise adjustment of the printing plates parallel to the axis is essential, the leading edges of which printing plates have to be aligned exactly parallel to the axis of the plate cylinder.

The restriction of the adjustment possibilities in the known device to a parallel displacement of the sheets in the circumferential direction is based on the fact that the transfer cylinder has a drum which can be adjusted relative to its shaft in the circumferential direction and on which the sheet rests, such that it is impossible to turn the sheet obliquely relative to the circumferential direction using this device.

SUMMARY OF THE INVENTION

The present invention is based on the object of improving the known device of the type described at the beginning in such a way that not only an adjustment of the sheet in the circumferential direction is possible, but also an adjustment of the sheet slightly obliquely relative to the circumferential direction in order thus to be able to take account of any possible oblique position of the printing plates attached to the plate cylinder. Additionally, the construction of the device is to be simplified.

This object is achieved according to the invention by the features specified in the defining clause of patent claim 1.

The fact that, during each revolution of the transfer cylinder, each of the two ends of the movably mounted setting plate is individually adjustable by a predeterminable amount allows, in a simple manner, not only displacement of a sheet in the circumferential direction, but also turning to an oblique position if the two ends of the setting plate are namely adjusted by different amounts. In this case, only the movably mounted setting plate with the sheet grippers and not, as in the known device, an entire drum needs to be adjusted relative to the cylinder shaft.

A preferred embodiment is described in claims 2 and 3.

Further expedient designs, in particular a preferred design of the control means which actuate the two setting means, emerge from the other dependent claims.

BRIEF DESCRIPTION OF THE DRAWINGS

The invention is explained in greater detail by way of an exemplary embodiment with reference to the drawings, in which.

DESCRIPTION OF THE PREFERRED EMBODIMENTS

Figure 1:
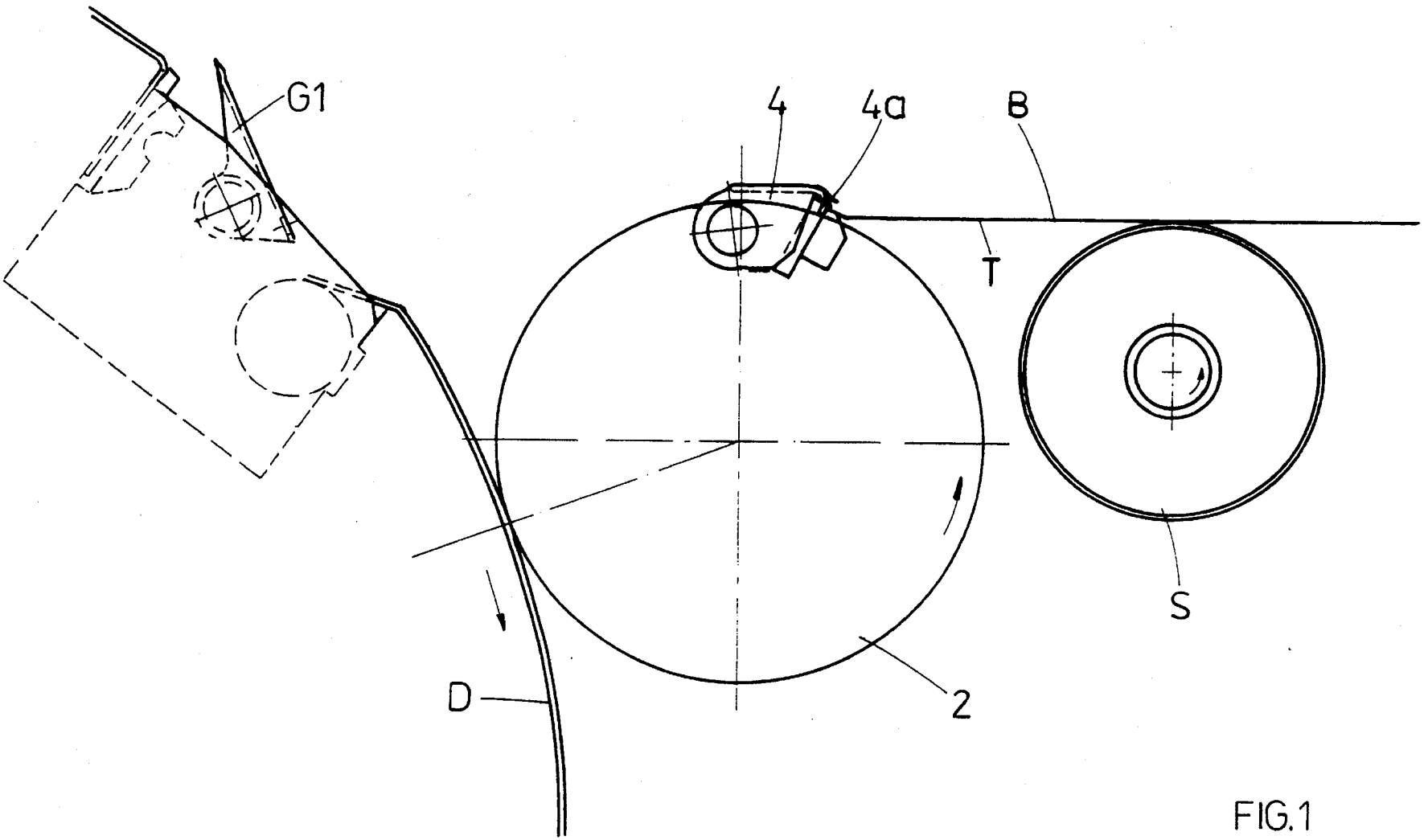
FIG. 1 shows the arrangement of the transfer cylinder on the impression cylinder of a printing machine in the sheet-receiving position and FIG. 2 in the sheet-transfer position, all the details of the transfer cylinder and the setting means having been omitted.
Figure 2:
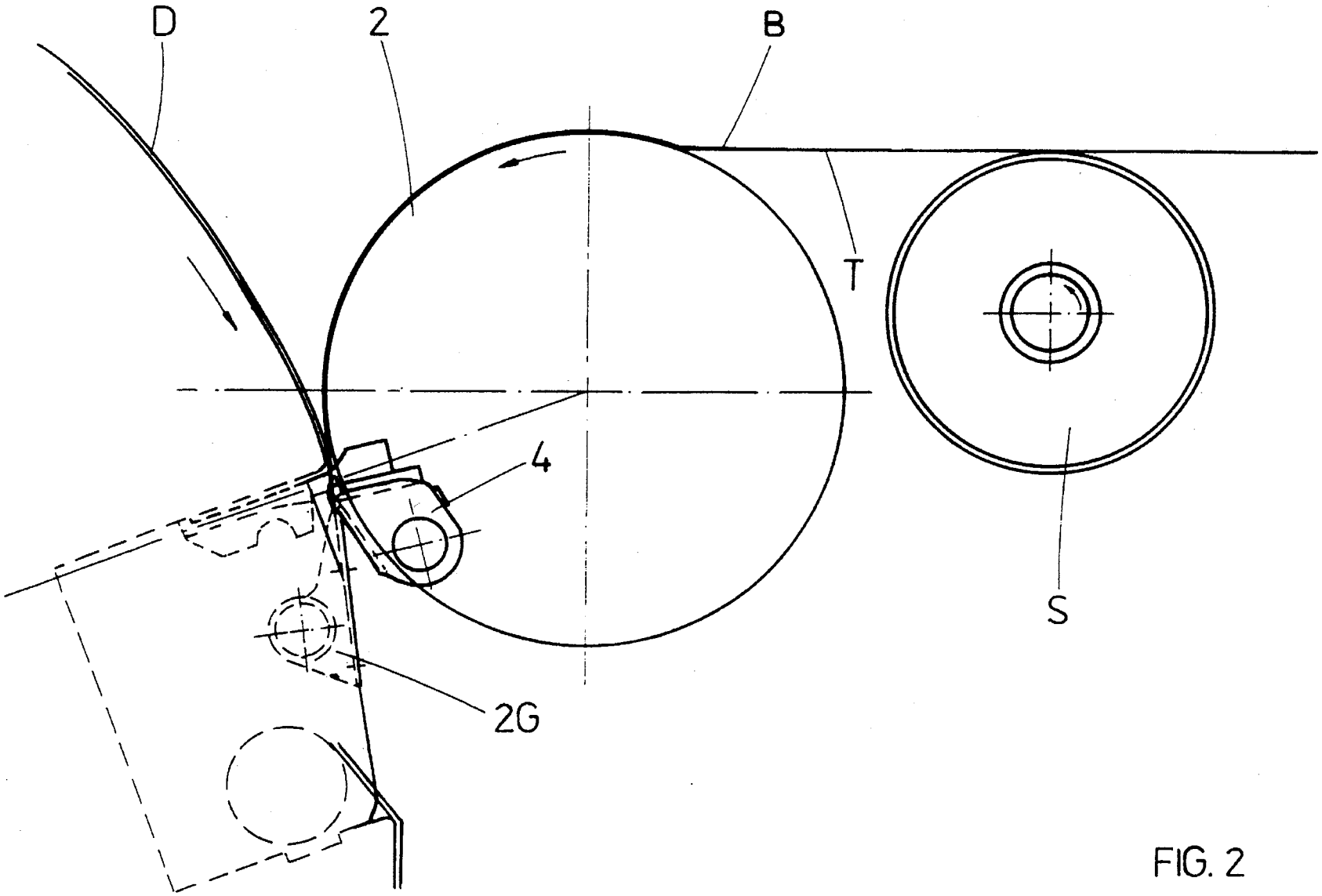
Figure 3:
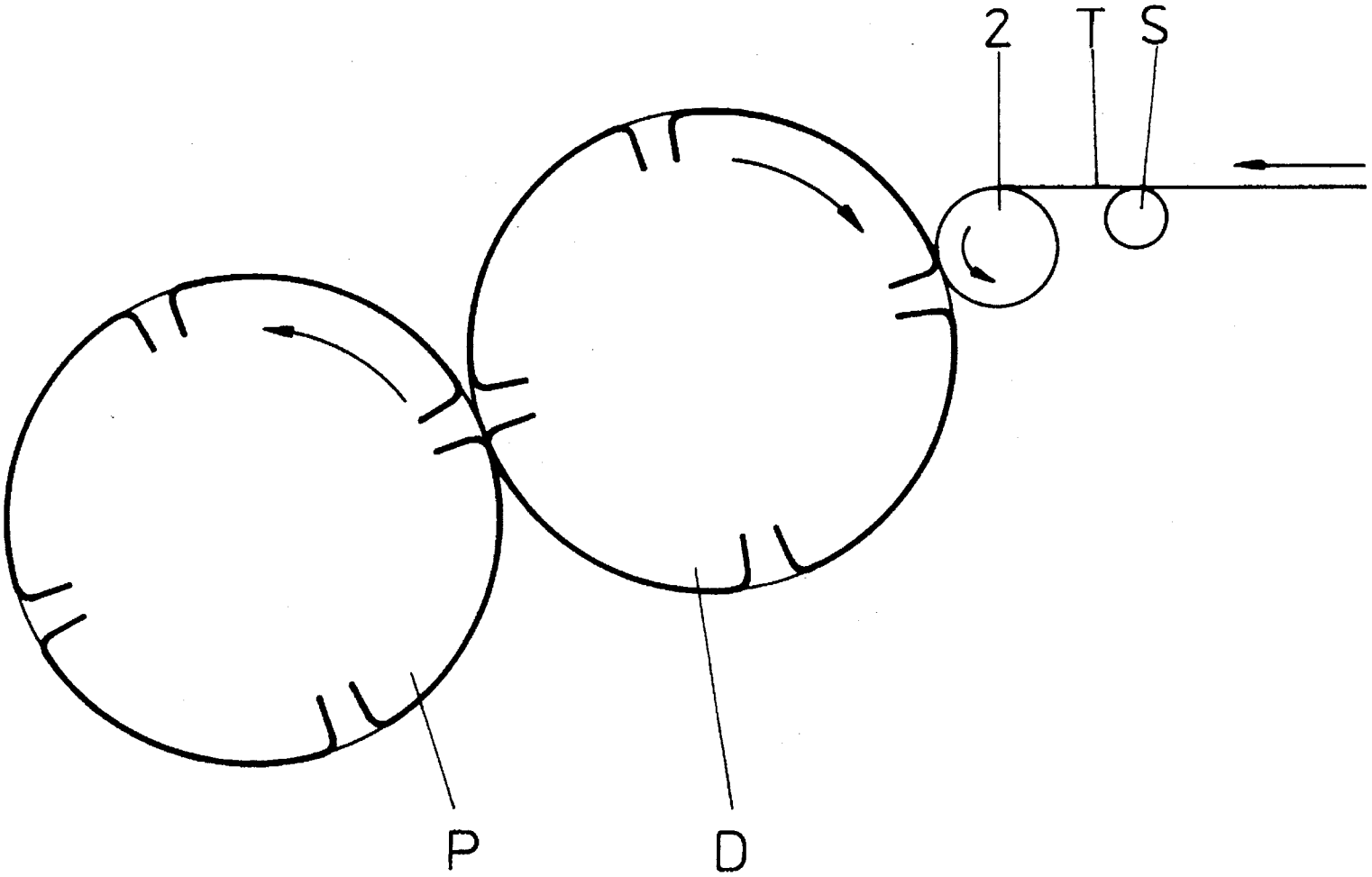
FIG. 3 shows a diagrammatic illustration of the arrangement according to FIG. 1 on a reduced scale, together with the plate cylinder which interacts with the impression cylinder.

According to FIGS. 1 to 3, the transfer cylinder 2 of the device is arranged between a feed roller S and the impression cylinder D of a rotary printing machine, in particular an intaglio printing machine, whose plate cylinder P (FIG. 3) interacts in a known manner with the impression cylinder D. The directions of rotation of all the cylinders are indicated by arrows in the FIGS. 1 to 3.

The plate cylinder P has at least two printing plates, generally N printing plates, N being greater than 1.. In the example considered, the plate cylinder P has four printing plates which are mounted at an angular interval of approximately 90°, that is to say do not necessarily have to be adjusted precisely to a fraction of a millimeter at a 90° interval, and which can also have deviations from the axial parallelism. In FIG. 3, the four printing segments of the impression cylinder D and of the plate cylinder P are indicated.

The sheets B are moved by the feed roller S individually one after the other via a feed table T (indicated only diagrammatically) and are passed to the transfer cylinder 2, every arriving sheet being conveyed against the front stop 4*a* of the sheet grippers 4 linked to the transfer cylinder 2 and being carried along by said sheet grippers until they are transferred to the impression cylinder D. The feed roller S can, in particular, be a known suction roller driven at a non-uniform speed. In the illustration according to FIG. 1, an arriving sheet B is just being taken over by the sheet grippers 4 and, in the illustration according to FIG. 2, the leading edge of the sheet B is being transferred by the transfer cylinder 2 to the sheet grippers G2 of the impression cylinder D.

During one full revolution of the plate cylinder, the transfer cylinder 2 completes N revolutions, that is to say four revolutions in the example considered, and it has a diameter which amounts to 1/N of the diameter of the plate cylinder P, that is to say a quarter of said diameter in the example considered. During each revolution, the transfer cylinder 2 conveys one sheet.

In the example considered, the impression cylinder D and the plate cylinder P are of equal size and, since there are four printing plates, the impression cylinder D has four printing segments covered with rubber blankets and, ahead of each rubber blanket, sheet grippers of which the grippers G1 can be seen in FIG. 1 and the grippers G2 can be seen in FIG. 2.

In the region of the feed roller S a known front lay (not illustrated here) is usually also provided, which serves to align an arriving sheet B and is subsequently pivoted downwards so that said sheet can be conveyed onto the transfer cylinder 2.

Figure 4:
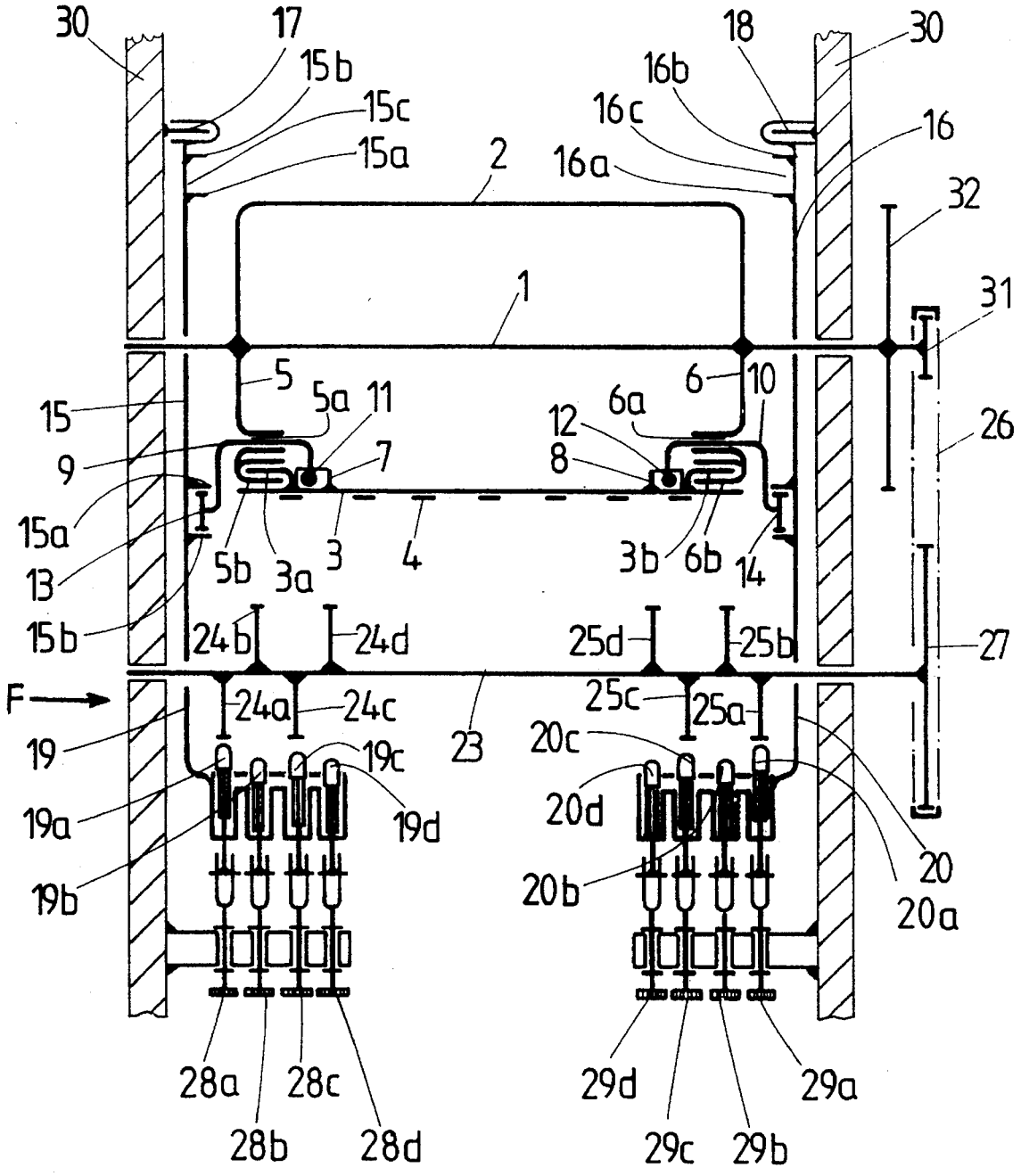
FIG. 4 shows a diagrammatic illustration of the transfer cylinder shown in axial section, of the setting means and of the control devices.
Figure 5:
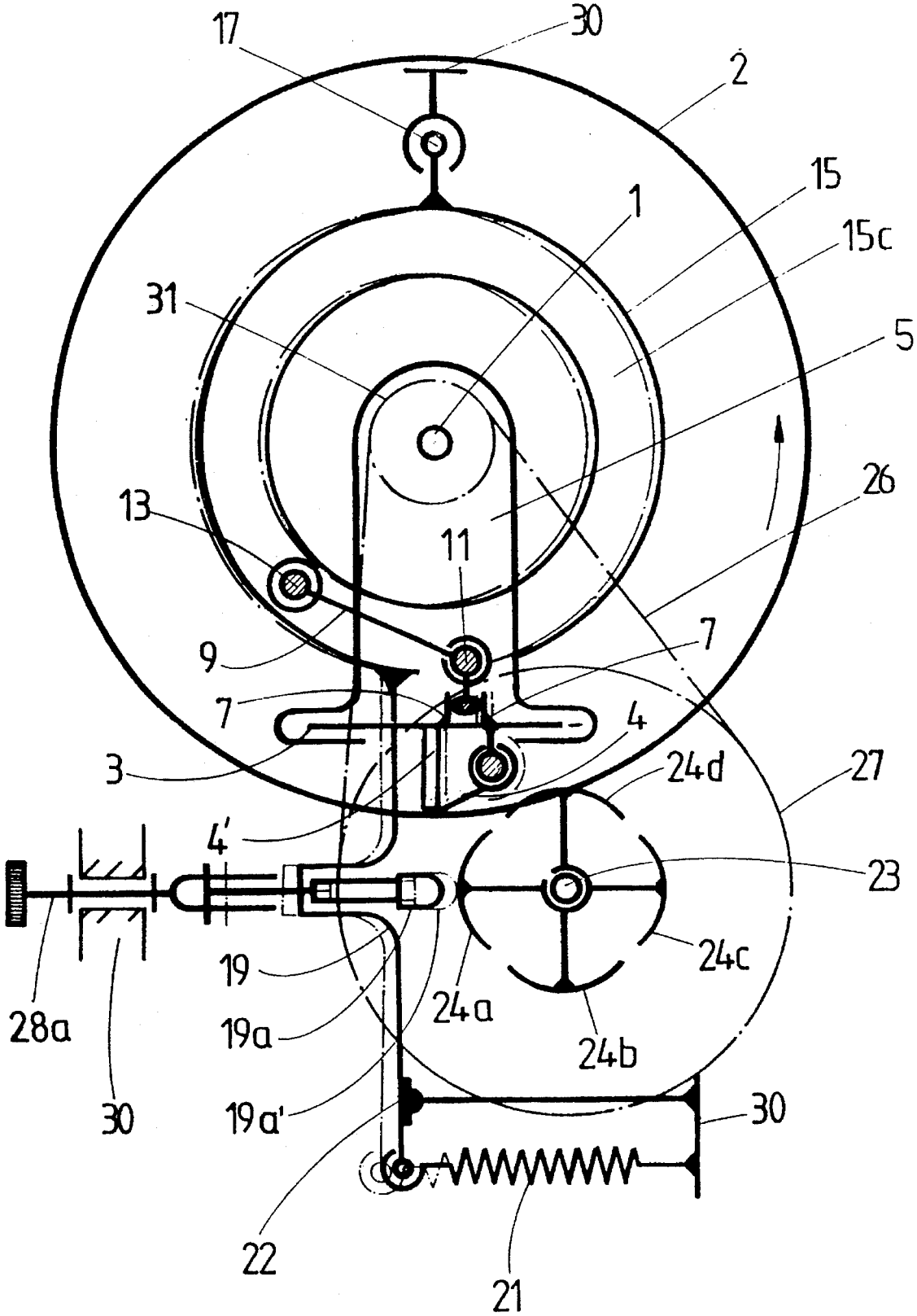
FIG. 5 shows a diagrammatic illustration in the direction of the arrow F according to FIG. 4, specifically in the zero position and, in dot-dashed lines, in the position of maximum deflection of the one actuator, the transfer cylinder having been drawn larger than in FIG. 4 to give a clearer picture of the setting means.

According to FIGS. 4 and 5, in which the feed roller S, the feed table T and the impression cylinder D are not illustrated, the transfer cylinder 2 is mounted by its shaft 1 so as to be rotatable in the machine frame 30 and is driven at a uniform speed by the impression cylinder by means of a gear 32 which is attached to said shaft 1 and engages in the impression-cylinder gear. In this case, the transfer cylinder 2 thus completes four revolutions when the plate cylinder P does one full revolution. Since the impression cylinder D has the same diameter as the plate cylinder P, as is usually the case, this naturally corresponds to one revolution of the impression cylinder D. In principle, however, the impression cylinder can also have a different diameter from that of the plate cylinder, in particular a smaller diameter, it being possible for the impression cylinder, for example, to be just as large as the transfer cylinder.

The sheet grippers 4 which interact with a gripper or sheet rest 4' are arranged on the transfer cylinder 2 so as to be adjustable to the respective adjustment of the position of the arriving sheets. For this purpose, the sheet grippers 4 are mounted on a setting plate 3 which is mounted movably in the two side walls 5 and 6 of the transfer cylinder 2. For this purpose, the setting plate 3 has, at its two ends, guide projections 3*a* and 3*b* which engage in guide slots 5*b* and 6*b* respectively in the side walls 5 and 6. Linked to these side walls 5 and 6 are roller levers 9 and 10 which are pivotable in bearings 5*a* and 6*a* respectively in these side walls about axes lying parallel to the shaft 1. These roller levers are provided with carriers 11 and 12 at their ends protruding into the transfer cylinder 2 and with running rollers 13 and 14 at their other ends.

The carriers 11 and 12 engage in each case between two stop parts 7 and 8 respectively which are attached to the setting plate 3, extend essentially parallel to the shaft 1 and are located opposite one another in the circumferential direction of the transfer cylinder 2. These stop parts 7 and 8 serve as a clearance-free guide for the carriers 11 and 12 respectively. The running rollers 13 and 14 engage in each case in an annular guide path 15*c* and 16*c* respectively which is formed by two mutually concentric annular projections 15*a*, 15*b* and 16*a*, 16*b* respectively of an annular actuator 15 or 16 respectively on the one or the other side and which surrounds the shaft 1. The two actuators 15 and 16 are suspended so as to be pivotable in each case about a journal 17 and 18 respectively, attached to the device frame 30 above the shaft 1, so that they can be tilted about an axis lying parallel to the shaft 1. The arrangement is such that the running rollers 13 and 14 can roll along the annular guide paths 15*c* and 16*c* without clearance while the transfer cylinder 2 rotates.

With the aid of the control means described below, the actuators 15 and 16 can be pivoted individually about the journals 17 and 18 in a plane oriented perpendicular to the shaft 1, as a result of which, as explained below, the setting plate 3 with its sheet grippers 4 can be adjusted relative to the body of the transfer cylinder 2 parallel to the circumferential direction thereof or into a position oriented obliquely relative to the circumferential direction.

Each of the actuators 15 and 16 has its own control means. Both control means are of identical construction and each have a lever arm 19 or 20 respectively which is attached to the region of the actuator 15 or 16 respectively facing away from the journal 17 or 18 respectively. As shown in FIG. 4, the same number of individually adjustable stops 19*a* to 19*d* are attached to the lever arm 19 as there are printing plates provided on the plate cylinder, that is to say four adjustable stops in the example considered. Accordingly, the individually adjustable stops 20*a* to 20*d* are provided on the lever arm 20.

In FIG. 4, the lever arms 19 and 20 are illustrated, for reasons of clarity, with their stops turned downwards through 90° relative to their actual position which is shown in FIG. 5. These stops 19*a* to 19*d* and 20*a* to 20*d* lie adjacently and can interact in each case with a control eccentric in the form of a cam 24*a* to 24*d* and 25*a* to 25*d* respectively. All the cams are seated on the shaft 23, mounted rotatably in the device frame 30, and have the shape of segments which extend in each case over an angle of approximately 360°/N, that is to say over approximately 90° in the example considered. The angular interval of adjacent cams is 360°/N, that is to say 90° in the example considered, so that, for example, the cam 24*a* or 25*a* can act on the stop 19*a* or 20*a* respectively during a quarter-revolution of the shaft 23, while the other cams 19*b* to 19*d* or 20*b* to 20*d* are ineffective; in the following quarter-rotation of the shaft 23, the cam 24*b* or 25*b* can then act on the stop 19*b* or 20*b* respectively while the other cams are ineffective, etc.

The arrangement is such that, during one full revolution of the transfer cylinder 2, the shaft 23 with the cams completes one quarter-revolution. For this purpose, a gear 27 is attached to the one end of the shaft 23, the diameter of which gear is four times as large as a gear 31 on the shaft 1, and which is driven by said gear 31 by means of a toothed belt 26. In general, the shaft 23 with the cams completes 1/N revolutions during one full revolution of the transfer cylinder.

As shown in FIG. 5, the lever arm 19 with its stops 19*a* to 19*d* is drawn, by a tension spring 21 which is attached to the lever end and whose other end is attached to the frame 30, in the direction of the cams 24*a* to 24*d* or in the direction of a fixed stop 22 which is mounted on the frame 30. In the position illustrated by continuous lines in FIG. 5, the lever arm 19 rests against the fixed stop 22 under the effect of the spring 21 since all the adjustable stops 19*a* to 19*d* assume a position which is sufficiently remote from the cams 24*a* to 24*d*. This position of the lever arm 19 with the actuator 15 is described as the zero position in which the annular guide path 15*c* lies concentrically to the axis 1 of the transfer cylinder 2.

In the position of the device illustrated by dot-dashed lines in FIG. 5, the stop 19*a* assumes the position 19*a'*. In this position, it is adjusted to such an extent in the direction of the cam 24*a* assigned to it that said cam strikes against said stop when passing through its effective position and presses it back to such an extent that the lever arm 19 with its actuator 15 is pivoted about the journal 17 in the clockwise direction relative to the zero position counter to the effect of the spring 21. This dot-dashed position is intended to represent the maximum deflection.

The above description applies equally to the arrangement and functioning of the other actuator 16 with its lever arm 20 for which a corresponding tension spring and a corresponding fixed stop are provided, and to the interaction of the stops 20*a* to 20*d* with the cams 25*a* to 25*d*. Since the two actuators 15 and 16 can be controlled independently of one another, the one actuator can assume its zero position while the other actuator is pivoted out of its zero position to a greater or lesser extent.

During each full revolution of the transfer cylinder 2, the actuators 15 and 16 are either left in their zero position or adjusted about the fixed journal 17 or 18 respectively individually according to a given program which is defined by the individual adjustment of the adjustable stops 19*a* to 19*d* and 20*a* to 20*d*, depending on whether a cam 24*a* to 24*d* or 25*a* to 25*d* respectively pushes or does not push the assigned adjustable stop 19*a* to 19*d* or 20*a* to 20*d* respectively back by a greater or lesser amount when passing through its effective position.

The essential factor is the position of the setting plate 3 at that moment at which the leading edge of a sheet located on the transfer cylinder 2 is transferred, whilst the sheet grippers 4 are open, to the sheet grippers of the impression cylinder D, as illustrated in FIG. 2. The position of the sheet at this point in time determines the later, in-register adaptation of said sheet to the relevant printing plate of the plate cylinder. It is to be assumed in the following that the two positions illustrated in FIG. 5 are these positions during the sheet transfer.

The zero position is selected such that any required correction of the position of the sheet only needs to take place in the one circumferential direction. The maximum possible deflection is adapted to the magnitude of the tolerance of the plate attachment, that is to say by experience the maximum inaccuracy in the attachment of the plates to the plate cylinder.

The actuators 15 and 16 are located in that position of the transfer cylinder in which its sheet grippers 4 take over an arriving sheet, and said sheet grippers are thus constantly in the zero position. If correction of the sheet position is not required, the relevant stop is adjusted in such a way that it is not contacted by the relevant cam. During the transfer of a sheet from the transfer cylinder 2 to the impression cylinder D, both actuators 15 and 16 therefore continue to assume their rest position, as shown in FIG. 5 by continuous lines for the lever arm 19 with the actuator 15, and the guide paths 15*c* and 16*c* lie concentrically to the cylinder axis 1. Therefore no displacement of the setting plate 3 with the sheet grippers 4 takes place, and the sheet does not undergo any displacement on the transfer cylinder 2.

It shall be assumed that, for the purpose of positional correction, the following sheet has to be displaced into an oblique position relative to the circumferential direction, specifically into the maximum oblique position. For this purpose, the following adjustable stop 19*b* is displaced by the maximum possible amount in the direction of the cams, which is illustrated for the position 19*a'* of the stop 19*a* by dot-dashed lines in FIG. 5. After the transfer cylinder 2 has completed one full revolution and therefore the cam shaft 23 has completed a quarter-revolution, the following cam 24*b* assumes its operating position and brings about a maximum deflection of the lever arm 19 with the actuator 15 by striking against the stop 19*b*. As is to be assumed, the other actuator 16 remains in its zero position. Owing to the deflection of the actuator 15, its guide path 15*c* is pivoted towards the left eccentrically to the cylinder axis 1 in the illustration according to FIG. 5. As a result, the setting plate 3 with the sheet grippers 4 at their left-hand end according to FIG. 5 is displaced by the roller lever 9 in the one circumferential direction, while its other end remains non-displaced. The sheet transferred onto the impression cylinder D is therefore in an oblique position which corresponds to the corresponding oblique position of the printing plate on the plate cylinder.

Analogously, the guide path 16*c* and thus the other end of the setting plate 3 can, of course, also be displaced by corresponding adjustment of one of the stops 20*a* to 20*d* on the other side, such that the sheet is displaced obliquely in the other direction.

If the corresponding stops 19*a* and 20*a*, 19*b* and 20*b* etc. have been adjusted by the same amount on both sides and are therefore pushed back by the same amount by the cams 24*a* and 25*a* or 24*b* and 25*b* etc. assigned to them, this then means that the two actuators 15 and 16 are adjusted by the roller levers 13 and 14 by exactly the same amount in the same circumferential direction. This results in a purely parallel displacement of the sheet. Only if the two ends of the setting plate 3 are adjusted by different amounts based on different adjustments of the simultaneously effective stops 19*a* and 20*a*, 19*b* and 20*b* etc., does this correspond to the adjustment of the relevant sheet into an oblique position.

The stops 19*a* to 19*d* and 20*a* to 20*d* are adjusted individually in such a way that, during each rotation of the transfer cylinder, an individual correction of the position of the setting plate 3 and thus of the position of the sheet takes place in such a way that, during the transfer of the sheet to the impression cylinder, said sheet assumes the position required to achieve a perfect printing register. In this way, after printing, all the sheets have a constant margin width between the leading edge and the beginning of print.

This individual adjustment of the stops 19*a* to 19*d* and

20*a* to 20*d* takes place, in the example considered, by means of the diagrammatically illustrated adjusting screws 28*a* to 28*d* and 29*a* to 29*d* respectively.

Such an adjustment of the stops can take place either by hand, for example by means of the diagrammatically illustrated adjusting screws, prior to the printing operation based on some trial prints, or setting motors are provided for this purpose, each of which is assigned to an adjustable stop. These setting motors are either actuated from a control panel by pressing keys or they are controlled as a function of the register deviations which are measured automatically by reading off register lays. In the case of non-printed sheets, this purpose is served, for example, by the register lays which are applied during printing and by means of whose readings the positions of the subsequent sheets are corrected. When the arriving sheets already have a first print, for example a background, register lays applied in the first printing unit can then serve for the automatic register correction.

In general, it is sufficient to provide a maximum displacement of the setting plate 3 of two millimeters, for example, relative to the transfer cylinder 2 because the adjustment of the printing plates on the plate cylinder with a tolerance of a maximum of two millimeters is possible without difficulty and without taking up much time.

The device according to the invention is not restricted to the exemplary embodiment described, but permits a variety of design embodiments.

I claim:

1. A device for transferring single sheets to the impression cylinder (D) of a sheet fed rotary printing machine which has a plate cylinder (P) provided with N printing plates, N being a whole number greater than 1, having a transfer cylinder (2) which interacts with the impression cylinder (D), whose diameter is 1/N of the diameter of the plate cylinder (P) and which completes N revolutions when the plate cylinder (P) does one revolution, having sheet grippers (4) which are installed on the transfer cylinder (2), have a front stop (4*a*) for the arriving sheets (B) and are adjustable by a controllable setting means (9, 10, 15, 16) during each revolution of the transfer cylinder (2) in such a way that, when passing through the transfer position in which a sheet is transferred to the impression cylinder (D), the front stop (4*a*) assumes a position by means of which the precise register of said sheet is adjusted relative to the position of the printing plate which prints it on the plate cylinder (P), wherein the sheet grippers (4) are mounted on a setting plate (3) mounted movably on the transfer cylinder (2), and wherein an individually controllable setting means (9, 11, 13, 15; 10, 12, 14, 16) engages at each end of said setting plate (3), which setting means displaces the relevant end of the setting plate (3) by a predeterminable amount relative to the transfer cylinder (2) in the circumferential direction thereof during each revolution of the transfer cylinder (2).

2. The device as claimed in claim 1, wherein each of the two setting means has an actuator (15; 16) which is arranged at the side of the transfer cylinder (2) and is suspended so as to be pivotable about a stationary journal (17; 18) above the axis (1) of the transfer cylinder (2) in a plane oriented perpendicular to said axis, wherein said actuator (15; 16) has an annular guide path (15*c*, 16*c*) which surrounds the axis (1) of the transfer cylinder (2), and wherein a roller lever (9; 10) is mounted pivotably in each case in each side wall (5; 6) of the transfer cylinder (2), one end (13; 14) of which roller lever is guided without clearance in the said annular guide path (15*c*, 16*c*) during rotation of the transfer cylinder (2), and the other end (11; 12) of which is set up to displace the relevant end of the setting plate (3) when the said guide path is located in an eccentric position relative to the axis (1) of the transfer cylinder (2).

3. The device as claimed in claim 2, wherein the said roller lever (9; 10) is pivotable about an axis oriented parallel to the axis (1) of the transfer cylinder (2) in the side wall (5; 6) of said transfer cylinder, and wherein the end of said roller lever acting on the setting plate (3) is a carrier (11; 12) which interacts with stop parts (7; 8) attached to the setting plate (3) and serving as a clearance-free guide.

4. The device as claimed in claim 2 wherein each actuator (15; 16) can be pressed under the effect of a spring (21) against a stationary stop (22) which defines a zero position of said actuator.

5. The device as claimed in claim 2 wherein a lever arm (19; 20) is attached to each actuator (15; 16), on which lever arm N stops (19*a* to 19*d*; 20*a* to 20*d*) are arranged adjacently and are individually adjustable by means of adjusting devices (28*a* to 28*d*; 29*a* to 29*d*), and wherein these adjustable stops can interact with N cams (24*a* to 24*d*; 25*a* to 25*d*) which are attached adjacently to a common shaft (23), located opposite the relevant stops, and at an angular interval of 360°/N, the shaft (23) bearing the cams completing 1/N revolution during one full revolution of the transfer cylinder (2).

6. The device as claimed in claim 5, wherein the individually adjustable stops (19*a* to 19*d*; 20*a* to 20*d*) are adjustable by means of adjusting screws (28*a* to 28*d*; 29*a* to 29*d*) or by means of setting motors which can be switched on by hand or can be controlled as a function of the register deviations which are measured automatically by reading register lays.

* * * * *